United States Patent [19]

Yun et al.

[11] Patent Number: 4,795,552

[45] Date of Patent: Jan. 3, 1989

[54] NATURAL FREQUENCY VIBRATING SCREEN

[75] Inventors: Jen Yun, Simpsonville, S.C.; Edward H. Breiling, West Allis, Wis.

[73] Assignee: Telsmith, Inc., Mequon, Wis.

[21] Appl. No.: 41,971

[22] Filed: Apr. 24, 1987

[51] Int. Cl.[4] ..... B07B 1/40

[52] U.S. Cl. ..... 209/319; 74/61; 209/341; 209/366.5; 209/368; 209/409

[58] Field of Search ..... 209/311, 315, 319, 325, 209/329, 341, 364, 365.1, 365.2, 365.4, 368, 409, 412, 326, 332, 363, 366, 366.5, 367; 74/61, 87

[56] References Cited

U.S. PATENT DOCUMENTS

| | | | |
|---|---|---|---|
| 1,997,499 | 4/1935 | Schieferstein et al. | 209/315 X |
| 2,116,225 | 5/1938 | Strube | 209/319 |
| 2,183,660 | 12/1939 | Symons | 209/409 |
| 2,191,504 | 2/1940 | Smith | 209/315 |
| 2,312,477 | 3/1943 | Pollitz | 209/329 |
| 2,984,339 | 5/1961 | Musschoot | 209/365.1 X |
| 3,047,152 | 7/1962 | Pollitz | 209/329 X |
| 3,112,653 | 12/1963 | Morris | 209/366.5 X |
| 3,317,041 | 5/1967 | Century | 209/315 |
| 3,468,418 | 9/1969 | Renner | 209/315 |
| 4,017,060 | 4/1977 | Brander et al. | 74/61 X |
| 4,040,303 | 8/1977 | Makino | 74/61 |
| 4,274,953 | 6/1981 | Jackson | 209/326 |

FOREIGN PATENT DOCUMENTS

| | | | |
|---|---|---|---|
| 1078364 | 3/1960 | Fed. Rep. of Germany | 209/325 |
| 2929806 | 2/1981 | Fed. Rep. of Germany | 209/319 |
| 0413689 | 7/1934 | United Kingdom | 74/61 |
| 0847301 | 9/1960 | United Kingdom | 209/315 |
| 0854463 | 11/1960 | United Kingdom | 209/341 |

*Primary Examiner*—Robert B. Reeves
*Assistant Examiner*—Edward M. Wacyra
*Attorney, Agent, or Firm*—James E. Nilles

[57] ABSTRACT

A horizontal vibrating multi-deck screen apparatus for separating different sizes of materials of generally the same type. The apparatus includes a first or upper screening basket and a second or lower screening basket. The upper screening basket has a feed chute at one end and a discharge chute at the opposite end. Each screening basket has at least one screen deck thereon for conveying and screening material. The two baskets are connected by a spring-type coupling system, including coil springs and fiberglass leaf springs. The two baskets together are supported by known types of support spring systems installed between the upper basket only and a base frame. Hence each basket constitutes one mass and each spring system one spring of a two-mass two-spring system. A pair of shaker motors mounted directly, one on each side, on the lower basket inputs a straight-line sinusoidal exciting force to the system. The exciting force and the spring forces are transmitted to both baskets and induce vibrations. By adjusting and controlling the masses of the baskets, the spring rates of the two spring systems and the magnitude of the exciting force, the desired vibrations will be achieved, with the operating frequency maintained near but below the upper natural frequency of the apparatus.

8 Claims, 2 Drawing Sheets

NATURAL FREQUENCY VIBRATING SCREEN

BACKGROUND OF THE INVENTION

This invention relates to vibrating screen apparatus for separating different sizes of materials of generally the same type, such as crushed rock and gravel, and in particular to such apparatus which employ natural frequency principles to reduce the amount of energy required to operate the apparatus and which employ shaker motors to impart straight line vibration to horizontally-oriented screen sections.

The majority of known horizontal vibrating screens employ a "brute force" method of applying the vibration to the particular screen. That is, a motor turns a drive unit which includes geared shafts with eccentric weights. This unit is attached directly to the screen or directly to a basket holding the screen. These known vibrating screens have one mass, mounted to a base by means of one set of springs, with the screen basket being the mass. While this method is effective to cause vibration and effect separation of the various sizes of components as required, it requires the input of large amounts of energy. There is need in the market for a vibrating screen which can accomplish the same amount of work using more efficient drive mechanisms.

In the 1950s, Hewitt-Robins, Inc., of Stamford, Conn., introduced a line of vibrating screens it called its "hi-G" screens. These screens have two masses and two spring mountings, and are said to require much less energy to operate. However, due to various conditions, those screens were not widely commercially successful.

This invention relates to improvements over the above apparatus and to solutions to the problems raised thereby.

SUMMARY OF THE INVENTION

The invention includes a vibrating screen apparatus for separating different sizes of materials of generally the same type. The invention calls for the apparatus to have a screen body divided into two screen baskets, a first or upper basket and a second or lower basket. The first screen basket has at least one screen deck thereon for screening the materials. The upper basket has a feed chute and a discharge chute. The lower screening basket is also provided with at least one screen deck for screening material. A coupling spring system connects the two baskets. This spring system includes a number of coil springs oriented at a predetermined angle, which angle determines the direction of vibration of the screens. The coupling system also includes at least four stacks of leaf springs mounted also between the two screen baskets, physically perpendicular to the coil springs but having spring action in the direction parallel with the coil springs. The entire two-basket assembly is mounted to a stationary base frame by means of a set of vertically arranged support springs between the upper basket and the frame. Thus the invention provides a natural frequency vibrating screen apparatus having two masses and two spring systems. The values of the masses of the screen baskets and the rates of the spring systems determine the natural frequency of the system. One embodiment of the invention includes means for adjusting the aforementioned values to vary the natural frequency. The invention also includes means mounted on the lower screen basket for causing vibratory movement of the apparatus in the direction of the coupling springs and at an operating frequency near but just below the upper natural frequency.

It is thus an object of the invention to provide a natural frequency vibrating screen apparatus having two masses and two spring systems, with its upper natural frequency near and just above the operating speed of the drive mechanism, allowing substantially reduced energy input while resulting in the same performance as single mass vibrating screens. Another object of the invention is to provide a screen apparatus as described above wherein the excitation is provided by a pair of shaker motors in place of a conventional geared eccentric drive unit for increasing the drive efficiency.

A more specific object of the invention is to provide a screen apparatus as described above wherein the upper and lower masses vibrate in directly opposite directions with unequal strokes by varying the values of the masses, the spring rates and the relationship between the upper natural and operating frequencies.

Another specific object of the invention is to provide a screen apparatus as described above wherein the exciter motors are attached to the side of the screen baskets for improved use of headroom.

Other objects and advantages of the invention will become apparent hereinafter.

DESCRIPTION OF THE PREFERRED EMBODIMENT

Figure 1:
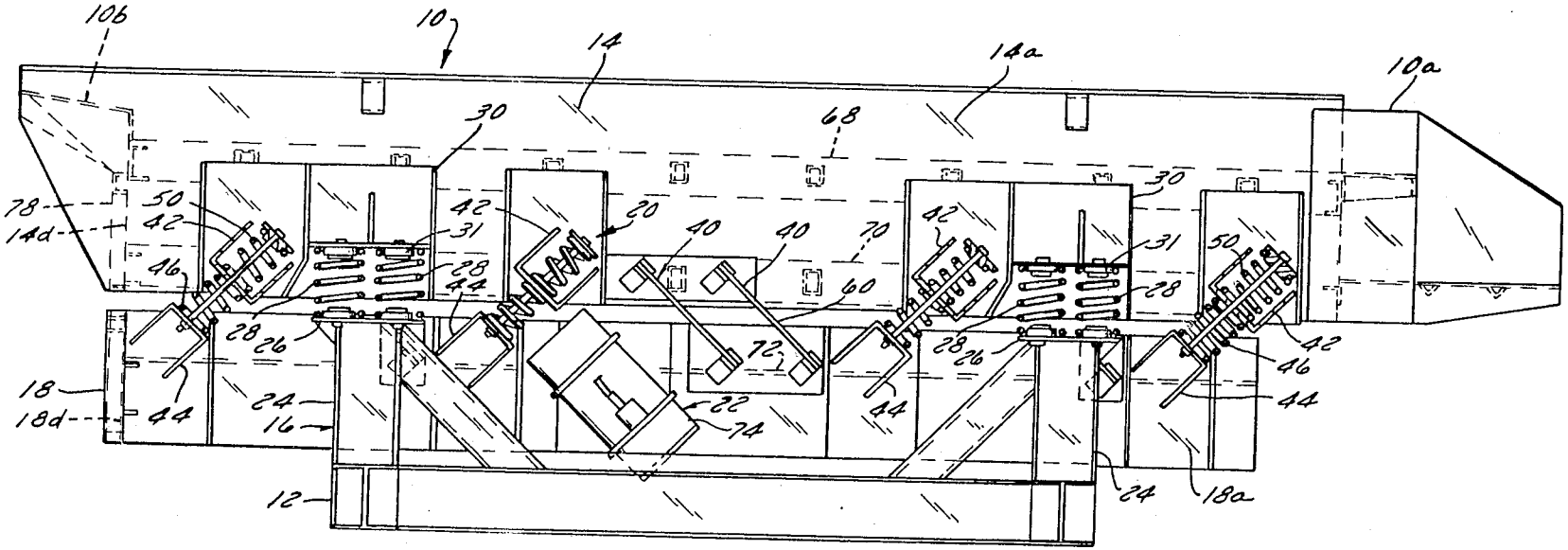
FIG. 1 is a side plan view of a vibrating screen apparatus constructed according to one embodiment of the invention.

Referring generally now to FIG. 1, a preferred embodiment of the invention calls for a vibrating screen apparatus 10, having a discharge chute **10*a* at one end and a feed chute 10*b* at its other end. The apparatus 10 includes a base member 12 at the bottom thereof, suitable for supporting the rest of the apparatus 10. An upper screening basket 14 is supported above the base 12 by mounting means 16 configured to allow vibrating motion between the upper basket and the base. A lower screening basket 18 is connected to the upper screening basket 14 by spring-type coupling means 20 designed to induce vibrating motion in the upper basket and the lower basket. Exciter means 22 are attached directly to the lower basket 18 for generating the necessary force to induce vibration in the upper and lower baskets 14 and 18**.

Figure 2:
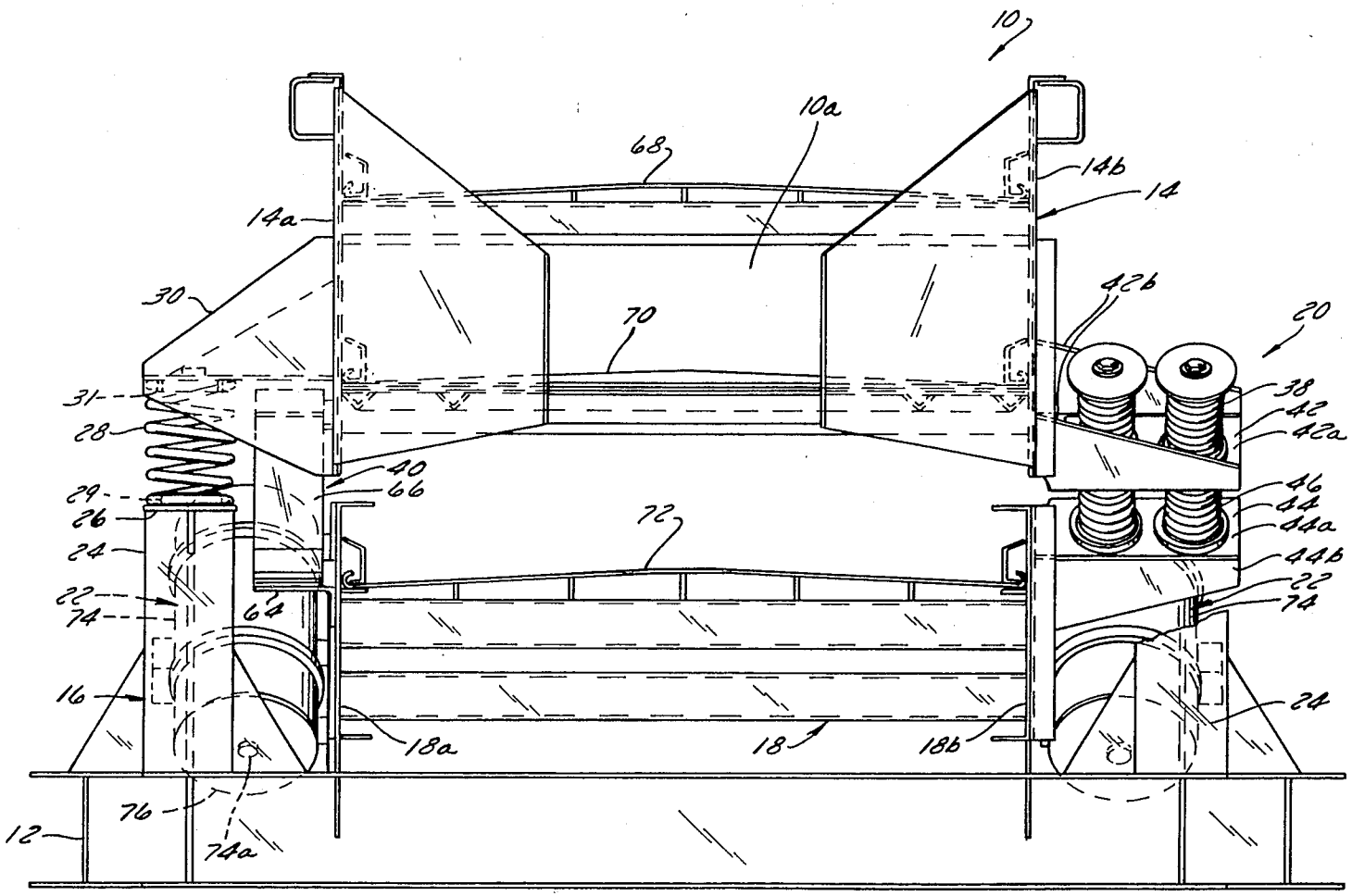
FIG. 2 is an end view of the vibrating screen apparatus shown in FIG. 1 from the discharge end thereof.

In particular, each mounting means 16 includes a plurality of support columns 24 extending upward from and attached to or formed integrally with the base 12. Preferably there are at least two such support columns 24 at each side of the base 12 for a total of at least four such columns. Each support column 24 has permanently secured thereto, such as by welding, at least one spring support plate 26, also shown in FIG. 2, at the top of the column. At least one support spring 28, and preferably several, are positioned generally vertically upon each of the support plates 26, each retained by suitable lower spring retainers 29 (FIG. 2). The upper screening basket 14 then rests on the support springs 28 by means of one spring bracket 30 for each support column 24.

Each spring bracket 30 is permanently attached to the respective side wall 14*a* and 14*b* (FIG. 2) of the upper screening basket 14 by any suitable permanent means such as welding, and extends laterally outward from the respective side of the basket. A suitable upper spring retainer 31 is positioned between each spring bracket 30 and the respective support spring 28 to hold the support spring 28 in place.

As stated above, the lower screening basket 18 is connected to the upper screening basket 14 by spring-type coupling means 20 designed to induce vibrating motion in the upper basket and the lower basket. This spring coupling means 20 includes a plurality of coil spring assemblies 38 and preferably also a plurality of leaf spring assemblies 40.

Figure 3:
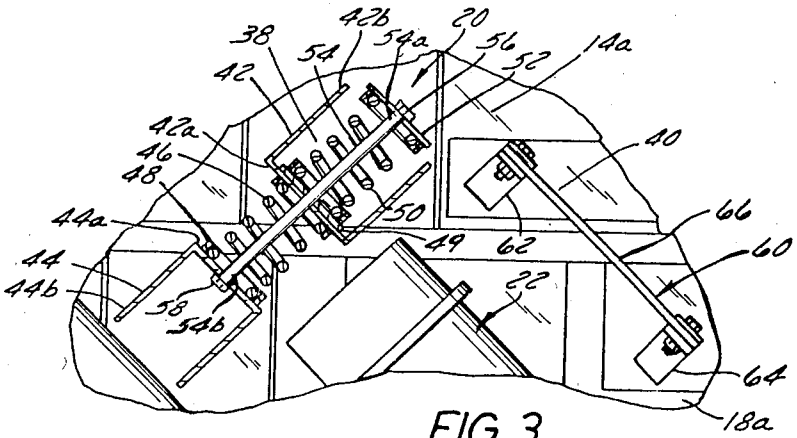
FIG. 3 is an enlarged view, partially in section, of a portion of the spring-type coupling means of the vibrating screen apparatus shown in FIG. 1.

As shown in more detail in FIGS. 2 and 3, each coil spring assembly 38 includes an upper bracket 42, permanently attached to side 14*a* or 14*b* of upper screening basket 14 such as by welding. Similarly, each assembly 38 includes a lower bracket 44, permanently attached to side 18*a* or 18*b* respectively of lower screening basket 18. Both brackets 42 and 44 are shown to be of a squared-off U-shape for reinforcement purposes, each having a mounting plate 42*a* and 44*a* respectively. These mounting plates 42*a* and 44*a* are parallel to each other, aligned with each other and positioned at a predetermined angle to the horizontal, for example, 45 degrees, as shown in FIGS. 1 and 3. This angle determines the direction of relative vibration or oscillation between the two baskets 14 and 18. Each bracket 42 and 44 also includes uprights 42*b* and 44*b* respectively, each approximately perpendicular to the respective mounting plate 42*a* and 44*a*.

A lower coil spring 46, preferably of steel, is positioned between each of the mounting plates 42*a* and 44*a* and held there between a lower spring retainer 48, attached to or integrally formed with lower mounting plate 44*a*, and the underside of a double sided spring seat 49, attached to upper mounting plate 42*a*. An upper coil spring 50 is positioned above the mounting plate 42*a* of upper bracket 42, and retained there between an upper spring retainer 52 and the top side of spring seat 49. The spring retainer 52 is held in place at the top of the spring 50 by a spring guide rod 54. Rod 54 is preferably drilled and tapped at both the top end 54*a* and the bottom end 54*b*. The upper spring retainer 52 is then preferably bolted to the top end 54*a* by a bolt 56. The bottom end 54*b* is bolted to the lower mounting plate 44*a* by a bolt 58, with the body of rod 54 running inside the length of the two springs 46 and 50. The amount of preloading of the springs 46 and 50 is determined by the length of the spring guide rod 54 and the length of the springs themselves.

In addition to the coil spring assemblies 38 connecting the upper basket 14 to the lower basket 18, a plurality of leaf spring stabilizer assemblies 60 also connect the baskets together. In the preferred embodiment, each of the stabilizer assemblies 60 simply includes an L-shaped bracket 62 attached to the upper basket 14, and a similar L-shaped bracket 64 attached to the lower basket 18, with one or more stabilizer bars 66 bolted or otherwise removably attached therebetween. Each bracket 62 and 64 has one flat facing the respective attached basket side wall 14*a*, 14*b*, 18*a* and 18*b*, and the other flat extending outward perpendicular to the respective side wall and parallel to the mounting plates 42*a* and 44*a* of the brackets 42 and 44 respectively. Each stabilizer bar 66 is preferably a simple, flat rectangular bar, preferably formed of a nonmetallic material such as fiberglass to better withstand the substantial vibration inherent in the application. At least four such stabilizer assemblies 60 are generally employed. While the stabilizer bars 66 of these stabilizer assemblies 60 are physically perpendicular to the coil springs 46 and 50, their spring action of course is in the direction parallel with the coil springs.

Within the upper basket 14 in the preferred embodiment, there are preferably two screening decks, a top deck 68 and a middle deck 70, as shown best in FIG. 2. Lower basket 18 then contains a bottom deck 72. Generally the top deck 68 will separate out the largest size of the materials to be separated. The middle deck 70 will be intermediate in size, and the bottom deck 72 will have the finest screen. Anything that falls through the finest screen, at deck 72, may be caught by a conveyor (not shown) and transported away by that means.

As indicated above, the apparatus 10 includes an exciter means 22 attached to the lower basket 18 for causing the lower basket to vibrate, and through the spring-type coupling means 20 for also causing the upper basket 14 to vibrate. In the preferred embodiment, the exciter means 22 includes at least two shaker motors 74, one attached to each side wall 18*a* and 18*b* of the lower basket 18. Preferably each shaker motor 74 has adjustable weights 76 attached at each end of its shaft 74*a*. These weights 76 are provided with the capability to be adjustably unbalanced by known means to cause vibration, when energized, at a frequency determined by the speed at which the motor is rotating. Such motors 74 are readily available from several sources including VIMARC, a Dutch brand. These shaker motors 74 are attached and controlled so as to rotate in opposite directions to each other and at the same speed, thus generating a straight-line sinusoidal force.

The thery of operation is as follows. The apparatus 10 is arranged as a two-mass, two-spring system. The masses are the screening baskets 14 and 18, while the springs are the spring-type coupling means 20 and the support springs 28. In one embodiment of the invention, the apparatus 10 is provided with means for adjusting the masses of the baskets 14 and 18, considering the type and volume of material to be separated by the apparatus 10. In particular, metal plates 78 may be removably bolted to any suitable location on each basket, such as the flat vertical surface 14*d* of upper basket 14 facing outward from the feed chute 10*b* of the apparatus and the similar surface 18*d* of lower basket 18. In addition, means may be provided for adjusting the spring rates of the spring-type coupling means 20 and/or the support springs 28. These rate adjusting means include the replacement of the various springs with springs having different spring rates. The purpose of the stabilizer assemblies 60 is to further tune the apparatus 10 and ensure true and correct action from the two exciter motors 74 which make up the exciter means 22 in the preferred embodiment. The number of stabilizer bars 66 in each of these stabilizer assemblies 60 may also be adjusted or changed so as to further adjust the spring rates as indicated above.

Generally, the apparatus 10 operates at a constant frequency, with each of the two screening baskets vibrating at a separate fixed stroke, and the two strokes may be but are not necessarily equal. The optimal operating frequency is a frequency about 6 to 10 percent below the natural frequency of the apparatus 10. The natural frequency of any apparatus such as apparatus 10 is defined as the frequency of free vibration of a mass-spring system. This natural frequency can be adjusted by the addition or removal of stabilizer bars 66 in stabilizer assemblies 60, the addition or removal of weights 78 to one or the other, or both, of the screening baskets 14 and 18, and by the replacement of any of the springs which constitute part of the spring-type coupling means 20 or support springs 28 with springs having different spring rates. The natural frequency is increased by the addition of stabilizer assemblies 60, the removal of weights 78, and the substituting of heavier springs for the spring-type coupling means 20 or support springs 28. It follows, then, that the natural frequency is decreased by actions opposite to those above. Assuming a natural frequency of about 970 cycles per minute, the optimal operating frequency will generally be about 900 cycles per minute. The operating frequency may be controlled and varied by any known device for controlling the motor speed of the shaker motors 74. As a consequence, the respective stroke of the screen baskets will vary as the operating speed of the shaker motors 74 changes.

This two-mass, two-spring arrangement allows the required vibration to be introduced by an exciter means 22 of much lower power than was previously required with known one-mass, one-spring arrangements. For instance, a five foot by sixteen foot triple deck screen similar to the one described above but constructed according to the one-mass, one-spring concept normally required about 25 to 30 horsepower of geared eccentric drive apparatus to drive the entire apparatus. When the apparatus 10 is constructed as described above according to the two-mass, two-spring arrangement, only about 7.6 horsepower is required to accomplish the same amount of work.

While the apparatus hereinbefore described is effectively adapted to fulfill the aforesaid objects, it is to be understood that the invention is not intended to be limited to the particular preferred embodiments of natural frequency vibrating screen herein set forth. Rather, it is to be taken as including all reasonable equivalents without departing from the scope of the appended claims.

We claim:

1. A vibratory screen apparatus comprising a first upper screening basket and a second lower screening basket, each basket having a deck that comprises a screen through which particles can pass that are smaller than a predetermined size, said first upper screening basket having a greater mass than said second screening basket, a normally stationary support frame on which the screening baskets are mounted in superimposed vertically spaced apart relationship with said first screening basket above said second screening basket and with their decks substantially parallel and relative to which each screening basket is oscillatingly movable for inducing material on its deck to advance thereacross in one direction, and exciter means for imparting oscillatory motion to both of said screening baskets, said apparatus being characterized by:

A. resilient supporting means at all times providing an elastic connection between said support frame and said first upper screening basket, said resilient supporting means being substantially symmetrically disposed in relation to the center of mass of said first upper screening basket and being arranged for
  (1) supporting said first upper screening basket from said support frame,
  (2) substantially confining said first upper screening basket to oscillatory motion relative to said support frame, and
  (3) constantly exchanging energy with said first upper screening basket during oscillatory motion thereof and thereby tending to maintain such motion;

B. coupling means at all times providing an elastic connection between said first upper screening basket and said second lower screening basket whereby said second lower screening basket is supported from and located below said first upper screening basket and is thus indirectly supported from said support frame and whereby said second lower screening basket is substantially confined to oscillatory motion relative to said support frame that is in phase opposition to the oscillation of said first upper screening basket,
  (1) said coupling means being disposed in substantially symmetrical relation to the center of mass of each of said screening baskets and
  (2) said coupling means comprising
    (a) a plurality of coiled coupling springs, each having an axis,
      (i) said coupling springs being connected between said screening baskets and
      (ii) all of said coupling springs having their axes inclined in one direction to planes in which said decks extend and at an angle thereto that is the same for all of the coupling spring axes, and
    (b) a plurality of resilient bars, each having at opposite ends thereof respective connections to said first upper screening basket and to said second lower screening basket, for constraining the screening baskets to oscillate counter to one another so that said coupling springs constantly exchange energy with both of said screening baskets during their oscillatory motions and thereby cause a system comprising the screening baskets, the resilient supporting means, said coupling means and the resilient bars to have a natural frequency of vibration;

C. said exciter means comprising
  (1) driver which defines a rotation axis and
  (2) a gyratory mass which is rotated eccentrically about said rotation axis at a rate to effect vibration of said system at a frequency which is near to but below said natural frequency of vibration; and D. said exciter means being rigidly fixed to said second lower screening basket in substantially symmetrical relation to the center of mass thereof.

2. The apparatus of claim 1, further characterized by:

E. means on at least one of said screening baskets for readily detachably securing weights to it in substantially symmetrical relation to its center of mass for adjustably varying its effective mass and thereby adjustably varying the relative amplitudes of oscillation of said screening baskets.

3. The vibratory screen apparatus of claim 1, further characterized in that:

said resilient supporting means comprises a plurality of coiled supporting springs, each of which has a spring axis, (a) said supporting springs being connected between said support frame and said first screening basket, and (b) each said supporting spring having its spring axis substantially vertical.

4. The vibratory screen apparatus of claim 1, further characterized by:

(1) each of said bars being resilient to cooperate with said coupling springs in constant exchange of energy with both of said screening baskets during their oscillatory motions, and (2) each said bar having its length inclined to said planes in a direction opposite to said one direction and at such an angle thereto as to be substantially perpendicular to the axes of said coupling springs.

5. The vibratory screen apparatus of claim 4 wherein said connections of said resilient bars to the respective screening baskets are readily releasable to provide for varying the number of resilient bars connected between the baskets and thus changing said natural frequency.

6. The vibratory screen apparatus of claim 1, further characterized in that:

(1) said exciter means comprises (a) a pair of drivers, each rigidly mounted on one of a pair of opposite sides of said second lower screening basket and each of which defines a rotation axis, and (b) a pair of gyratory masses, one for each driver, each driven by its driver for eccentric rotation about the rotation axis that its driver defines; and (2) said drivers being constrained to drive their respective gyratory masses at like rates of rotation but in opposite directions of rotation.

7. Vibratory screen apparatus comprising:

a stationary support frame:

a first upper screening basket having at least one screen deck and of predetermined mass;

support spring means for mounting said first upper screening basket on said support frame and symmetrically arranged relative to the center of mass of said first upper screening basket;

a second lower screening basket having at least one screen deck and of a lesser mass than said predetermined mass;

spring-type coupling means for mounting said second lower screening basket on and below said first upper screening basket and symmetrically arranged relative to the center of mass of both baskets;

stabilizer bar means, including resilient leaf springs, connected between the first upper and the second lower screening baskets;

and exciter means mounted on said second lower screening basket and symmetrically arranged relative to the center of mass of said second lower screening basket;

said screening baskets having a natural frequency of vibration determined by the values of the masses of said screening baskets and components connected thereto including, said exciter means, said spring support means and said spring-type coupling means and by the rates of said spring support means, said spring-type coupling means and said resilient leaf springs;

said exciter means being operable to effect vibratory movement of said screening baskets at a frequency of vibration near and below said natural frequency of vibration and at the same constant stroke frequency relative to each other.

8. Apparatus according to claim 7 further comprising adjusting means for adjusting said natural frequency of vibration.

* * * * *